United States Patent [19]

Zaehring et al.

[11] Patent Number: 4,752,182

[45] Date of Patent: Jun. 21, 1988

[54] DEVICE FOR THE OPEN- OR CLOSED-LOOP CONTROL OF GAS TURBINE ENGINES OR TURBOJET ENGINES

[75] Inventors: Gerhard Zaehring, Wörthsee; Christian Prodehl, Martinsried, both of Fed. Rep. of Germany

[73] Assignee: MTU Motoren-und Turbinen-Munench GmbH, Munich, Fed. Rep. of Germany

[21] Appl. No.: 937,675

[22] Filed: Dec. 4, 1986

[30] Foreign Application Priority Data

Dec. 4, 1985 [DE] Fed. Rep. of Germany ..... 3542762

[51] Int. Cl.[4] ..... F04D 29/46

[52] U.S. Cl. ..... 415/12; 415/46; 415/48; 415/211; 416/39

[58] Field of Search ..... 416/39; 415/12, 211, 415/144, 145, 46, 48

[56] References Cited

U.S. PATENT DOCUMENTS

| | | | |
|---|---|---|---|
| 2,253,406 | 8/1941 | Wagner | 416/39 |
| 2,789,808 | 4/1957 | Blackman | 415/12 X |
| 3,038,698 | 6/1962 | Troyer | 415/12 |
| 3,356,289 | 12/1967 | Plotkowiak | 415/211 X |
| 3,367,570 | 2/1968 | Reichmann | 415/12 X |
| 3,756,739 | 9/1973 | Boussuges | 415/211 X |
| 3,764,227 | 10/1973 | Albertzart | 416/39 |
| 4,054,398 | 10/1977 | Penny | 415/12 X |
| 4,164,845 | 8/1979 | Exley et al. | 415/211 X |
| 4,228,753 | 10/1980 | Davis et al. | 415/211 X |
| 4,431,374 | 2/1984 | Benstein | 415/211 |
| 4,445,815 | 5/1984 | Fortmann | 415/12 |

FOREIGN PATENT DOCUMENTS

| | | | |
|---|---|---|---|
| 0040532 | 11/1981 | European Pat. Off. . | |
| 961742 | 4/1957 | Fed. Rep. of Germany . | |
| 1033966 | 7/1958 | Fed. Rep. of Germany | 415/12 |
| 1055882 | 4/1959 | Fed. Rep. of Germany | 415/12 |
| 2428969 | 1/1975 | Fed. Rep. of Germany . | |
| 2834860 | 3/1980 | Fed. Rep. of Germany . | |
| 3147334 | 4/1983 | Fed. Rep. of Germany | 415/DIG. 1 |
| 68599 | 4/1982 | Japan | 416/39 |
| 204999 | 11/1983 | Japan | 416/39 |
| 211798 | 11/1984 | Japan | 415/211 |
| 870171 | 6/1961 | United Kingdom . | |
| 1126941 | 9/1968 | United Kingdom . | |
| 2085083 | 4/1982 | United Kingdom . | |
| 2084250 | 4/1982 | United Kingdom . | |
| 2102885 | 2/1983 | United Kingdom . | |
| 2104594 | 3/1983 | United Kingdom . | |
| 2149022 | 6/1985 | United Kingdom . | |

*Primary Examiner*—Everette A. Powell, Jr.
*Attorney, Agent, or Firm*—Barnes & Thornburg

[57] ABSTRACT

This invention covers elements, such as guide walls, shut-off flaps, flow dividers and vanes, arranged on or in flow ducts energized with compressor and/or fan air, where said elements are variably arranged to suit variable operating states. To achieve extremely accurate, light-weight and uncomplicated actuating kinematics, the elements are designed as memory-alloy components or are nonpositively connected to at least one such component, they are at least partially located at one end and they permit of selective deformation in response to operationally induced over-maximum or under-minimum temperature conditions.

24 Claims, 8 Drawing Sheets

Figure 1:
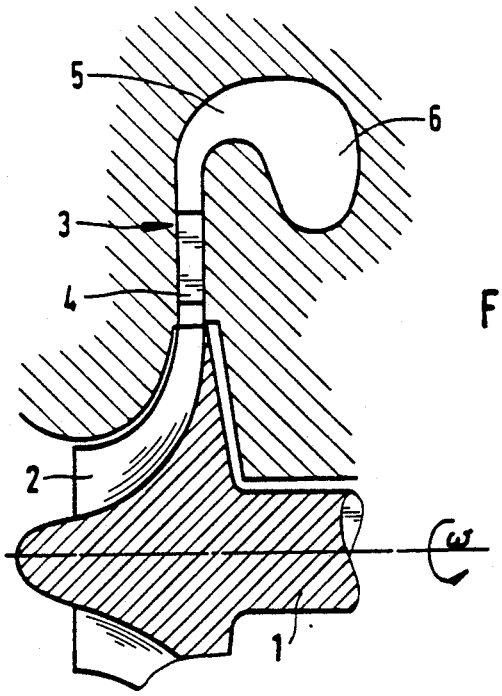

FIG. 13
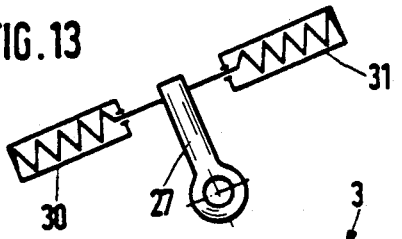
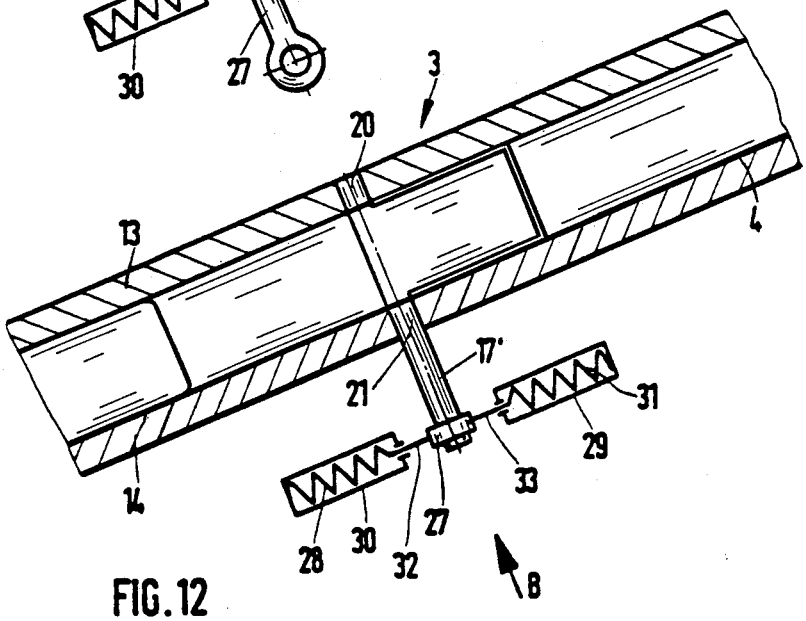
FIG. 12

DEVICE FOR THE OPEN- OR CLOSED-LOOP CONTROL OF GAS TURBINE ENGINES OR TURBOJET ENGINES

In order to control compressors and prevent compressor surge, axial-flow compressors are conventionally provided with variable guide vanes, which generally requires comparatively highly complex actuating means, especially when it is endeavored to transmit the vane actuating force as uniformly as possible to all variable vanes in a cascade, so as to combat mechanically induced binding factors; and apart from said comparatively high mechanical complexity the accuracy with which vanes are actuated may be greatly compromised by differences in thermal loads caused by the engine construction and by frictional loads on the vane actuating components. Additional components or component designs to compensate thermal expansion or minimize friction add to the complexity and, thus, at least partially to the susceptibility of the entire vane actuating system to breakdowns.

A vane actuating system for gas turbine engines discussed in the foregoing has been disclosed, e.g., in CH-PS 288242. In this known case an actuating force is applied unilaterally from the outside, i.e. via the respective compressor or turbine casing structure, to a locally extended vane journal to do the remaining vane actuation, for which purpose a vane actuating shroud is provided which is circumferentially rotatably supported in coaxial arrangement on rollers of a annular support structure, such that the shroud relays the unilateral actuating input to remaining vanes, which with their actuating link pins engage in slots in the actuating shroud.

The comparatively great complexity of actuating means discussed above is apparent also from prior-art variable diffusors of centrifugal compressors, where the respective flow or throat area between adjacent vanes can be widened by untwisting the respective diffusor vanes to extend the characteristic performance range of the compressor.

A centrifugal compressor diffusor of that description is known from, e.g., German patent specification DE-OS No. 2428969, where diffusor vanes - when viewed from inside looking out-take a wedge-like, uniformly widening shape and are each pivotally variable about a journal arranged relatively far upstream. Joint vane actuation is achieved by means of a vane actuating shroud which can be rotated coaxially along the respective diffusor wall and which uses pins to engage in uniformly designed and arranged exit holes in the diffusor vanes. This known solution accordingly likewise involves relatively great complexity of actuating means.

Great complexity of actuating means, plus highly involved and overly sensitive diffusor vane construction, also embarrasses a device disclosed in German patent specification DEPS No. 3147334 for the control of the throat areas between the diffusor guide vanes of a centrifugal compressor for gas turbine engines, where the diffusor guide vanes are provided with bypass ducts to establish communication between the vane pressure and suction sides.

Known also are variable-cycle turbojet engines the characteristic thrust and consumption performance of which can be varied within a certain range. Variation of engine characteristics is here achieved by varying the mass flows within the engine; this is achieved partially by actuating variable compressor and turbine stator cascades and partially also by admitting or interrupting the flow of air streams, e.g. by interruptible extraction of afterburner cooling air from the compressor. What all such engines have in common is variable splitting of the mass flow downstream of the low-pressure compressor into a core stream and a bypass stream by means of a variable flow divider.

With this arrangement considerable technical difficulty is encountered in the attempt to design the flow divider and its actuating mechanism—and to arrange it between the core and bypass flow ducts of the engine—such that the overall engine diameter is not inevitably increased over that of an equivalent, fixed-cycle engine, and that no additional components are needed that affect the flow in the core and bypass ducts.

The solution offered in German patent application DE-OS No. 2834860 attempts to eliminate said difficulty by making the flow divider an array of primary and secondary flaps, where the latter are pivoted together with the former and the actuating means are arranged essentially within a stationary casing annulus formed between an inner and an outer annular flow duct of the engine.

This known solution accordingly cannot likely be implemented but with considerable complexity of the actuating means involved.

The actuating mechanism here described still inevitably involves a radial widening of said casing annulus, which in turn carries the penalty of a correspondingly wider overall engine diameter. Also, essential additional components (straight shaft conduit for power transmission) become indispensible.

Additionally, all known actuating systems here discussed are disadvantaged by considerable dead weight.

In a broad aspect the present invention provides a device which at extremely modest mechanical complexity of actuating means is light in weight and which at extremely modest space requirement ensures accurate and reliable open- or closed-loop control.

It is a particular object of the present invention to provide a device of the generic category described in the foregoing introduction above, but having a simplified thermal responsive control and smooth flow conditions in respective positions of the control member.

With regard to the scope of design and application of so-called memory-alloy components or materials the present invention constitutes a substantial advance over prior art when compared with the previously cited conventional, extremely complex actuating systems for gates, flaps, vanes, flow dividers and similar components for gas turbine engines.

The term "memory alloy" or "memory effect" derives from the basic insight that a certain alloy may change between at least two phases in the solid state when characteristic temperature thresholds are exceeded in either direction. This memory effect is especially pronounced and exact in the nickel titanium alloy involved in the application of protection for the present invention.

The term "memory effect" accordingly bases on an experimentally gained impression that the respective alloyed component "remembers" its earlier form or shape, which gave rise to such nomenclature as "shape memory effect".

The inventive concept assumes that the respective memory element in the form of, e.g., a shut-off or control element, will initially retain the mechanical shape impressed on it at a low temperature even when the energization temperature rises. It is not before the energization temperature crosses a certain threshold that the respective component "recalls" its original state of form and returns to its original shape. By way of reshaping the respective component is capable of doing mechanical work and being used, e.g., as power input to control, e.g., a vane or shut-off flap. Essentially there are two differently evolving crystal structures of the material that may have a hand in the memory effect to produce the desired variable deforming effect.

Under the memory effect, deformation will generally be comparatively rapid or abrupt, so that the transition between the two states of form occurs within a temperature range of a mere few degrees centigrade.

By way of its strictly structural transformation, a memory component shows virtually no frictional or other wear; the inventive material for the purpose can be called "fatigue-resistant".

Further objects and advantages of the present invention will become apparent from claims 2 to 24.

Figure 2:
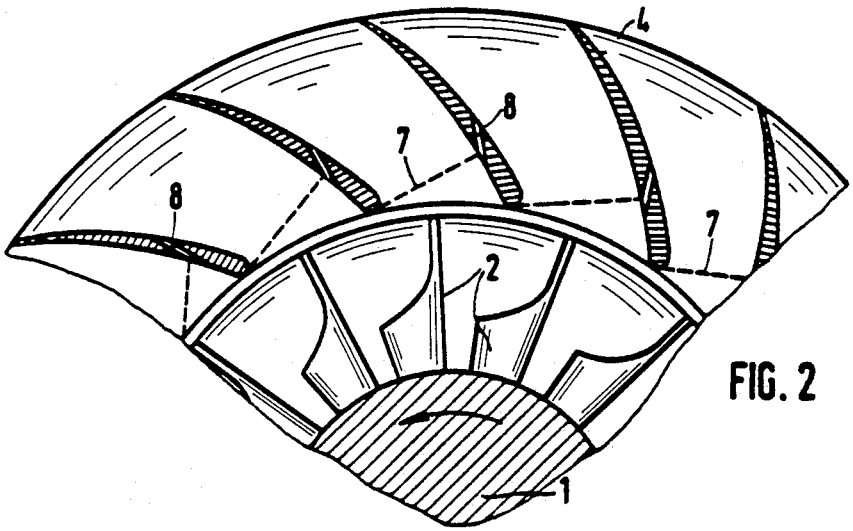
Figure 3:
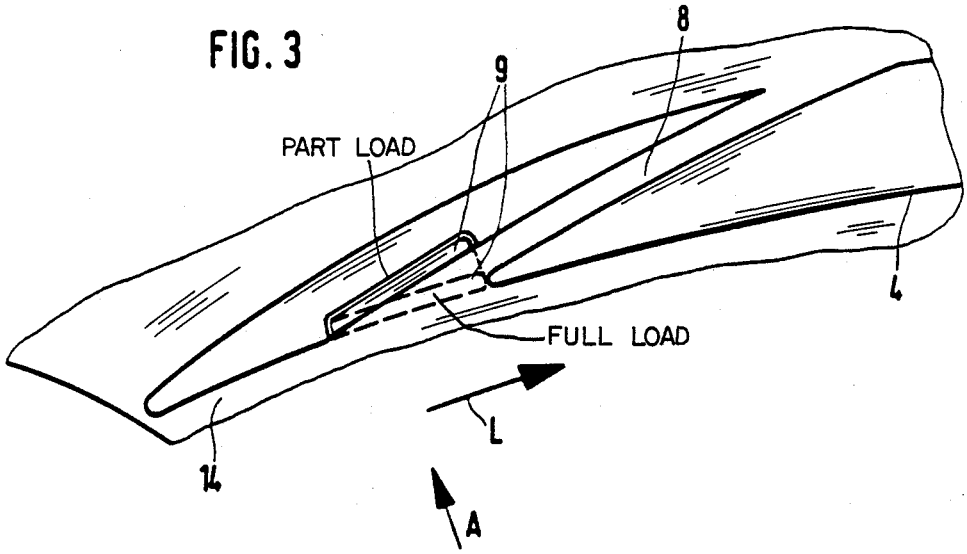
Figure 5:
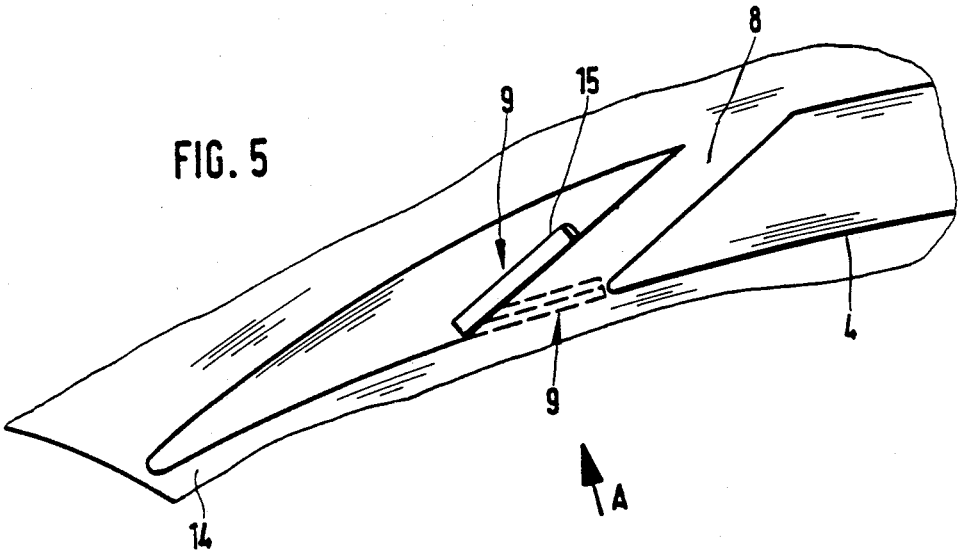
Figure 6:
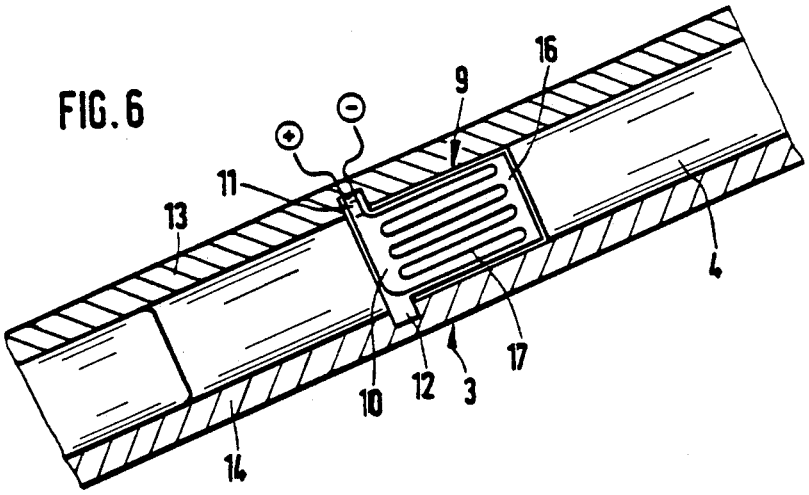
Figure 7:
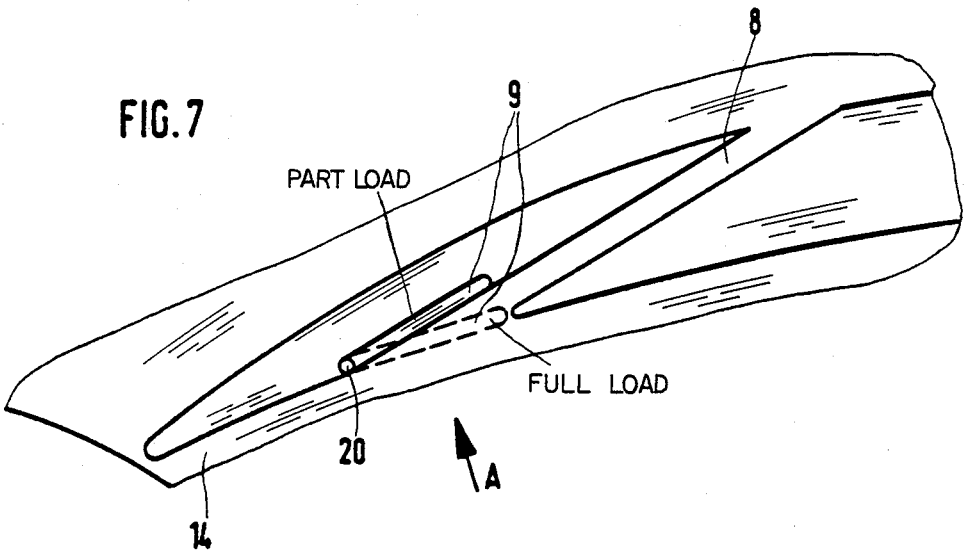
Figure 8:
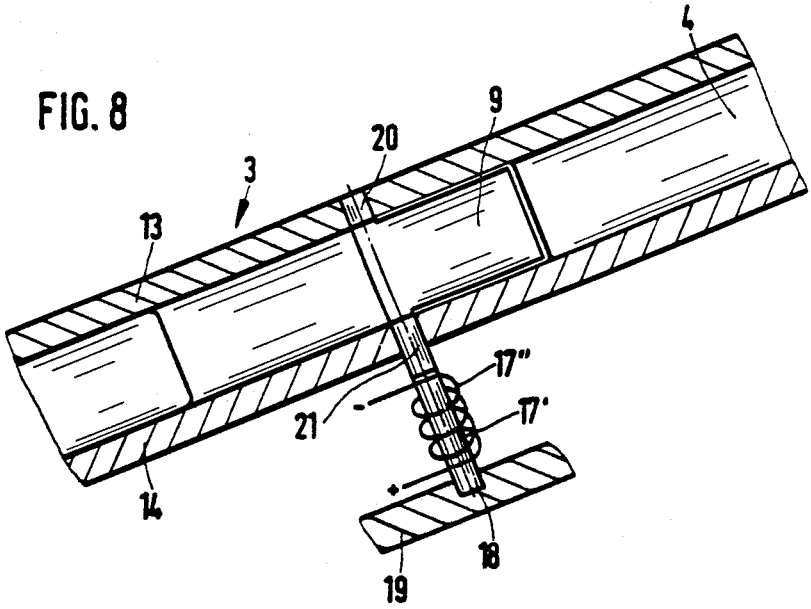
Figure 9:
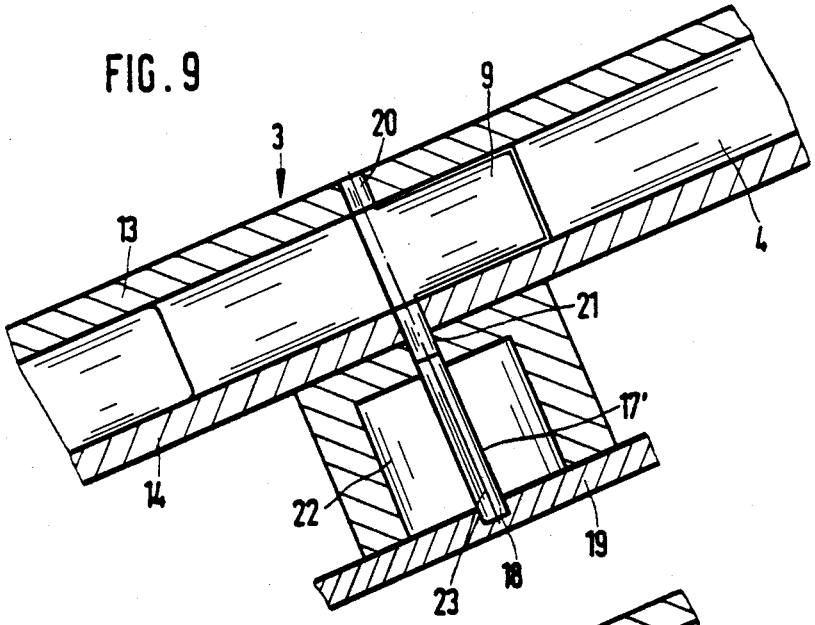
Figure 10:
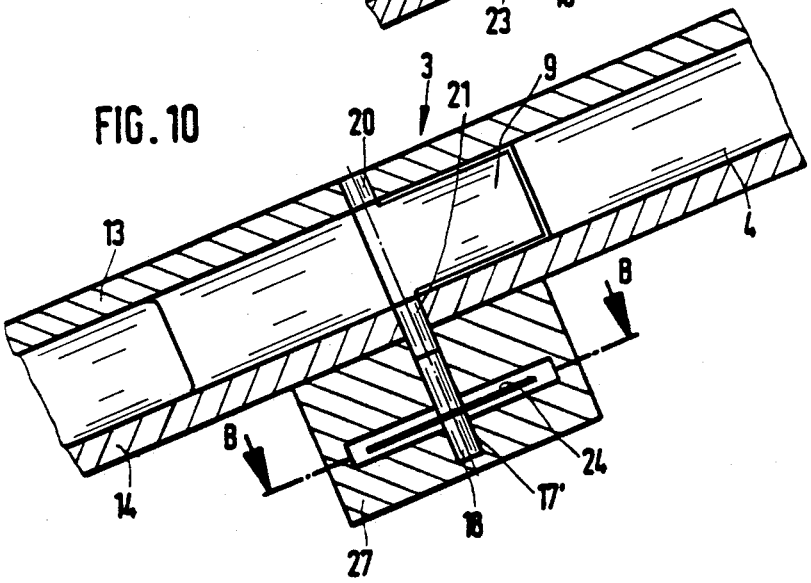

The invention is described more fully in light of the accompanying drawings based on a centrifugal diffusor vane control concept for a gas turbine engine, where FIG. 1 is an axially parallel section illustrating a centrifugal compressor section plus diffusor, FIG. 2 is an axially normal fragmentary sectional view illustrating the conmpressor plus diffusor of FIG. 1, FIG. 3 is a view reproduced from FIG. 2, but at another angle of incidence, illustrating the afflux end of a diffusor vane plus flap element in the form of memory alloy component, in two different extreme positions, FIG: 4 is a view on arrow A of FIG. 3 illustrating a diffusor section, FIG. 5 is a representation analogous to FIG. 3, but including a flap element which in conjunction with FIG. 6 is electrically heated, FIG. 6 is a view on arrow A of FIG. 5 illustrating a diffusor section, FIG. 7 is a reproduction analogous to FIGS. 3 and 5 of the afflux end of a diffusor vane, but here incorporating journal type bearing provisions for the flap element, FIG. 8 is a reproduction of the diffusor section viewed on arrow A of FIG. 7 in relative arrangement with a journal section which at one end is rotationally anchored in the casing, which is enveloped by a heating coil, and which is designed as a memory component and given a twisted form, FIG. 9 is a view on arrow A of FIG. 7 illustrating the diffusor section in relative arrangement with a journal section which is rotationally anchored in the casing, which in departure of FIG. 8 is arranged in a separate air chamber, and which is designed as a memory alloy component and given a twisted form, FIG. 10 is a view on arrow A of FIG. 7 illustrating the diffusor section in relative arrangement with a journal which in departure from FIGS. 8 and 9 is pivotally supported in the casing for rotation in either sense, and the one extreme section of which is here coupled to a memory coil in a disk-shaped chamber provided for the purpose.

Figure 11:
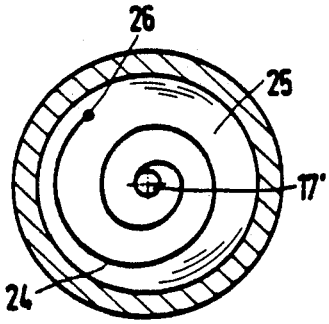
Figure 14:
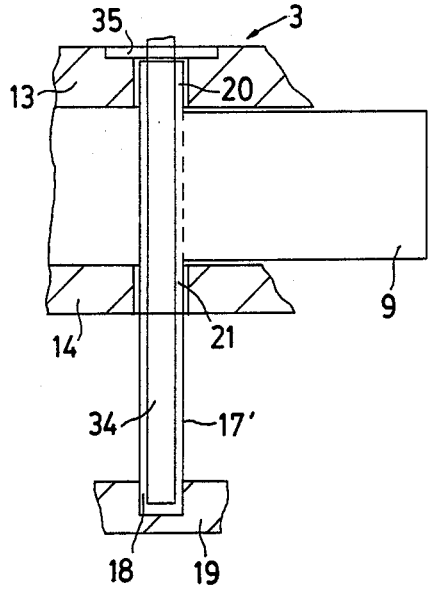
Figure 15:
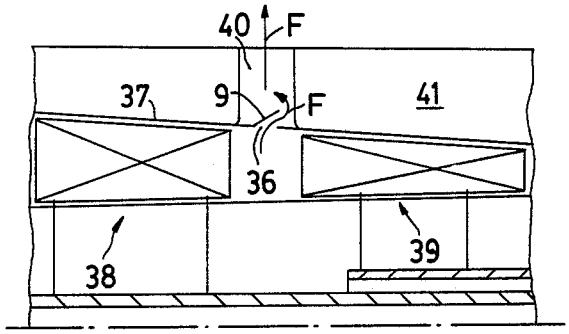
Figure 16:
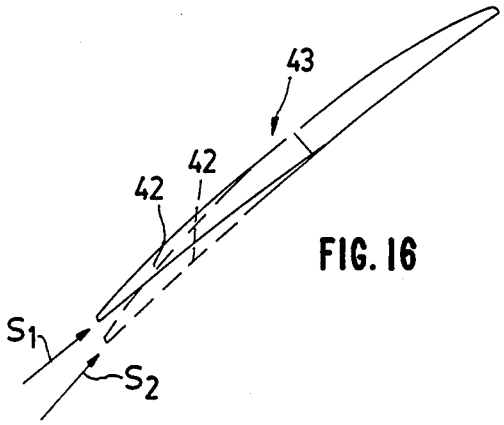
Figure 17:
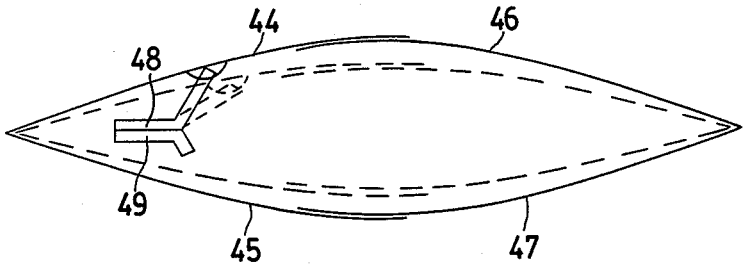

FIG. 11 is a sectional view taken at line B—B of FIG. 10,

FIG. 12 is a view on arrow A of FIG. 7 illustrating the diffusor section, where in departure from FIGS. 8, 9 and 10 a memory spring control arrangement is shown which through a lever acts on both sides of a journal end, FIG. 13 is a view on arrow B of FIG. 12 illustrating the memory spring arrangement with the spring housings sectioned, FIG. 14 is an enlarged fragmentary view from FIG. 9 with an electrical heating rod which projects from above into the journal extension, FIG. 15 is a schematic arrangement in longitudinal sectional view illustrating a memory-controlled air bleed arrangement between the intermediate and high pressure compressors of a multi-spool turbojet engine, FIG. 16 illustrates a variable-incidence axial-flow compressor vane, and FIG. 17 illustrates a stator vane made variable especially with reference to profile thickness.

Figure 4:
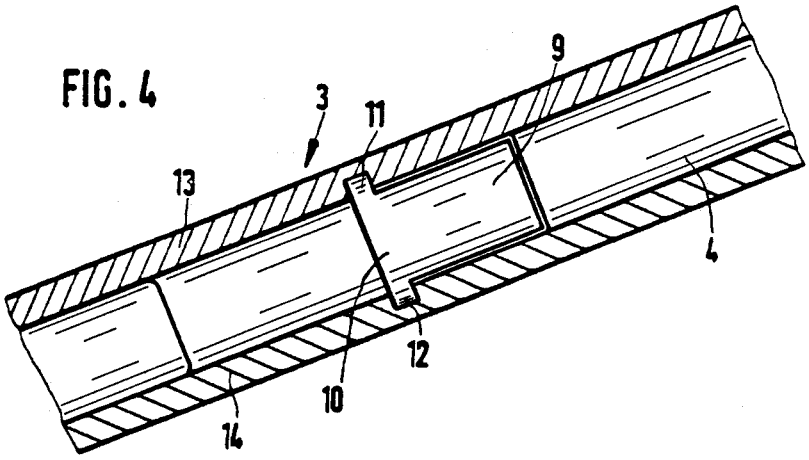

With reference now to FIG. 1, a schematic arrangement of a centrifugal compressor stage includes a rotor 1 and attached thereto the centrifugal compressor rotor blades 2. Immediately following the centrifugal compressor rotor exit is a centrifugal diffusor 3 with centrifugal diffusor guide vanes 4, where the centrifugal diffusor 3 issues at its exit end into a tubular bend 5 communicating with a scroll housing 6 to duct the compressed air to a gas turbine engine combustion chamber, which is omitted on the drawing. The centrifugal compressor rotor 1, then, turns the externally provided input energy arriving through the shaft into potential and kinetic energy of the gas. In the diffusor 3 with its vanes 4 the kinetic energy is then decelerated and partially converted into potential energy (pressure). Said deceleration is controlled by the contour of the diffusor vanes 4. The minimum throughput is limited by the diffusor throat areas 7 (FIG. 2). When the bypass ducts 8 are opened, the respective diffusor throat area 7 accordingly is widened and the throughput is augmented. With reference now to FIGS. 3 and 4 the elements operate as control or shut-off flaps 9 of the bypass ducts 8, where the flaps in a first extreme position (Part-load position/-bypass flow area 8 completely open) are stowed flush in a recess in a forward vane section. In a second extreme position (full-load position/bypass flow area 8 fully closed) the flap 9 is to lock the suction side of the vane in flush configuration. Deformation of the flap 9 from the partial-load into the full-load position (shown in broken line) is accordingly effected when a preselected temperature threshold of the compressor air L entering the diffusor 3 is exceeded. Then when the temperature drops below the preselected threshold, the flap 9 is redeformed to assume the first, or partial-load position. When a given deformation temperature (transition temperature) is reached, the flap 9—by way of its memory alloy—remembers the full-load deformation originally impressed on it and when a corresponding under-minimum condition of the deformation temperature is reached, the flap returns relatively fast to its initial, or part-load condition.

In accordance with FIG. 4 the elements serving the functions of control or shut-off flaps 9 can—in the case of a cast diffusor—be integrally cast at a forward end 10 unaffected by control deformation and through bilaterally radially projecting extreme sections 1, 12, with adjacent structural casing components or guide wall sections 13, 14 of the diffusor 3, or—in the case of a fabricated diffusor—they can be fixedly connected to these sections 13, 14 by locally embedding them.

Accordingly the elements here serving the function of, e.g., flaps 9 are partially locally fixed in a plane which with respect to their end 10 extends in parallel with the end face; with reference to this plane the elements can therefore be selectively deformed flap-fashion in correspondence with a comparatively abrupt control motion produced as a function of an operationally induced over-maximum or under-mimimum temperature condition of, e.g., the incoming compressor air S.

The flap-like elements 9 can also be located without difficulty along the entire end 10 which extends in parallel with the end face and is not involved in the control deformation (FIG. 4).

Generally, then, such flaps 9 (FIGS. 3 and 4) can be designed to respond with deformation to a certain variation in the compressor or fan air temperature of a gas turbine engine.

With the variant of FIGS. 5 and 6, which is a more fully developed version of that in FIGS. 3 and 4, the over-maximum or under-minimum temperature to trigger deformation can be achieved also by electrically heating the memory element designed to serve the function of a flap 9. The stowed, partial-load position in the forward vane section is shown in solid line. The numeral 15 here indicates the recess designed to accommodate the flap 9 when stowed. For electrical heating, use can be made, e.g., of a heating coil 17 wound on one side of the respective flap 9 (FIG. 6) More particularly, and as here illustrated, the electrically insulated heating coil 17 can be mounted on the outside of the flap 9. Alternatively the heating coil 17 could readily be integrated into the flap 9.

In lieu of the heating coil 17 as here described and illustrated, use can be made also of an electrically heated rod for a similar deforming function. The respective heating rod could be arranged in a bore of a journal or its extension.

FIGS. 7 and 8 illustrate a further advantageous variant, where a journal section or extension 17' is designed as a memory alloy component, with the one journal end 18 being fixedly arranged on the casing or a further casing section 19, while the remaining portion 20, 21 is pivotally supported in the guide walls 13, 14.

In accordance with FIGS. 7 and 8 the journal extension 17' in the form of a memory alloy component can additionally be a twisted design. This is a type of shape-memory torsion the material will remember (in order to achieve the full-load position) when a given heating temperature is exceeded. FIG. 8 also illustrates a stationary electrical resistance heating coil 17'' wrapped uniformly helically around a respective journal extension 17'.

With reference to FIG. 9 the respective journal extension 17' may be installed in a common annular chamber for all journals or in an associated separate chamber 22, where the annular chamber or the respective separate chamber is energized with process air which is taken from the cycle and the temperature of which is adapted to suit the desired deformation transition point. In this arrangement the flap 9 can again be pivotally supported along the journal sections 20, 21 in the diffusor guide walls 13, 14, and the extension 17' of the journal may again be a memory component and the one end 18 can be fixedly connected to the casing section 19. The journal extension 17' can again be twisted in the manner described with reference to FIG. 8.

Said annular chamber or the separate chambers 22 (FIG. 9) may be arranged coaxially to the engine centerline.

In a further advantageous aspect of the present invention the separate chambers 22 are arranged rotationally symmetrically to the respective journal centerline 23, as shown in FIG. 9.

Using the same reference numerals as in FIGS. 8 and 9 for essentially unchanged components, FIGS. 10 and 11 illustrate a variant where the memory component takes the form of a coil 24 enveloping the journal or its extension 17' and where the coil 24 is located at its one end on the journal extension 17' and at its other at point 26 in the separate chamber 25 formed by the casing (FIG. 11). Depending on the under-minimum or over-maximum condition prevailing at the time, the memory coil 24 can alternate between two different states of form (more extended or more contracted) and so do the mechanical work needed to control the flap 9.

In accordance with FIG. 10, then, the flap 9 is pivotally supported both in the diffusor guide walls, via journal sections 20, 21, and on the casing body 27 (FIG. 10) forming the separate chamber 25, via the one extreme journal end 18. In a further advantageous design apparent from FIGS. 12 and 13, where the respective element, or again flap 9, is supported by journal bearings at both ends, two each memory alloy spring components 28, 29 are provided which from one side act on a lever arm 27 of the journal or its extension 17' and of which the one, when a certain deformation transition temperature is reached, is extended while the other is contracted such that an operationally induced change in temperature produces the desired actuation of the flaps. As it will also become apparent from FIGS. 12 and 13 the memory-alloy spring components 28, 29 can be arranged in housings 30, 31, while the remaining spring component ends act on the lever arm 27 in the form of unrestrained arms each extending through an opening in the respective housing cover. These spring components 28, 29 can again be heated electrically or advantageously controlled in response to the engine condition by way of suitably admitted cycle air.

Especially advantageous control of, e.g., the throat areas 7 (FIG. 2) is achieved in adaptation to engine variables under the aero-thermodynamic cycle in that the deformation transition temperature provided by the air or heating system can be controlled by an engine control unit.

In accordance with FIG. 14 the journal of the flap 9 is a tubular shape. Inserted into the tubular journal from the outside is a heating rod 34. The heating rod 34 is attached to the outer diffusor guide wall 13 via an insulating plate 35. Otherwise the various components and functions carry the same numerals as in FIG. 9. In FIG. 14 the journal extension 17' is a twisted, tubular component.

In departure from the embodiments covered above the invention can find advantageous application also if at least one element 9 (FIG. 15) analogously reflecting the design and arrangement of the flap mentioned above is to control a port 36 provided in the compressor casing for compressor air bleed purposes (arrowheads F). In this arrangement, e.g., one or more such ports provided in the compressor duct wall 37, more specifically between, e.g., an intermediate-pressure compressor 38 and a high-pressure compressor 39, can selectively be opened or closed. The compressor bleed air can be vented to the atmosphere through, e.g., hollow struts radially extending through the bypass duct 41 of the turbojet engine. A typical extremely complex, mechanically controlled air bleed device for a turbojet engine will become apparent from U.S. Patent Specification No. 3,898,799.

The invention can also be provided by way of several circumferentially equally spaced elements of this description for controlling variable flow areas of a variable-cycle turbojet engine, where reference is made to the subject matter under the previously disclosed solution in accordance with German patent specification DE-OS No. 2834860 as covered above.

In accordance with FIG. 16 the subject matter of the invention can also be provided, with said elements analogously adapted, for optimizing the aerodynamic vane geometry. With the variant of FIG. 16, e.g., local afflux portions 42 of the compressor vane profile 43 can be memory alloy components, so that the angle of vane incidence can be adapted to suit the afflux angle of the incoming air stream S1 or S2.

In a further version of this last-named variant the vane wall sections, which can be widened on the pressure and/or suction sides, can be controlled by means of bimetal or memory-alloy components arranged in the vane cavity.

FIG. 17 illustrates a strut which can be deformed in terms of profile thickness to provide variable-size flow areas between adjacent vanes of this description to cater to variable air or gas flows. The vane profile consists of profile wall members 44, 45, 46, and 47 permitting of flexible displacement one over the other while remaining in positive contact; at the extreme points of the profile wall members are deformably located. Arranged within the vane cavity are memory components 48, 49 permitting of differing degrees of deformation. The component 48 can be deformed from the position shown in broken line (minimum profile thickness) to that shown in solid line (maximum profile thickness); this analogously applies to component 49, or for an equivalent assembly of memory components to be specified for the opposite end of the vane cavity. At their outer ends the memory components, e.g. 48, are connected to the profile wall portions, e.g. 44, via hinged joints. The components 48, 49 can, again, be heated electrically or energized with cycle air fed into the vane cavity. The memory-alloy components should advantageously be made of NiTi or CuZnAl or CuAlNi alloys.

In accordance with FIGS. 5 to 8, e.g., the flap-like shut-off elements 9 (FIGS. 5 and 6) or their actuating components (FIG. 8), which would here be typified by the respective journal extension 17', can be integrally connected at their respective fixation end 10 to the respective adjacent stator sections 13, 14 (FIG. 6) or 19 (FIG. 8). In a manner omitted on the drawings the inventive concept naturally also embraces the option of integrally connecting one end of the element performing the respective control or shut-off function to an associated stationary vane section.

As previously already indicated by analogy the element serving the control function can be cast integrally with adjacent structures of the casing of the engine or compressor already at the time the respective device is manufactured, with allowance made for minimum clearances along the control element to be deformed, starting with its connecting end, until the desired amount of deformation is achieved.

What is claimed is:

1. A diffusor guide vane construction for a radial compressor of gas turbine engine or the like turbo machinery comprising:

a diffusor guide vane which exhibits a pressure side and a suction side when in an in-use position in a turbo machine, a bypass duct extending through the diffusor guide vane for communicating the pressure side with the suction side, said bypass duct including a recess, and a thermally responsive control flap means mounted at the recess in the bypass duct, said control flap means being operable in dependence on engine operating induced temperature conditions to be automatically movable between a bypass duct blocking position where it forms a continuous surface closing the inlet end of the bypass duct and a bypass duct opening position where it is fully retracted into the recess means to form part of a continuous open duct.

2. A diffusor guide vane construction according to claim 1, wherein said movement of the control clap means is controlled by thermal memory alloy components.

3. A diffusor guide vane construction according to claim 1, wherein said control flap means are formed with memory alloy components which change shape in response to temperature changes.

4. A diffusor guide vane construction according to claim 3, wherein one end of the control flap means is fixedly connected along an end which extends in parallel with an adjacent guide surface and is unaffected by the control deformation.

5. A diffusor guide vane construction according to claim 3, wherein said temperature condition is the temperature of the air flowing past the guide vane.

6. A diffusor guide vane construction according to claim 2, comprising electrical heating means for inducing the temperature condition by electrically heating the memory alloy components.

7. A diffusor guide vane construction according to claim 6, wherein said electrical heating means comprises a heating coil which is integrated into the control flap means and the control flap means contains the memory alloy components.

8. A diffusor guide vane construction according to claim 6, wherein said electrical heating means comprises a heating coil which is wound on the surface of the memory alloy components.

9. A diffusor guide vane construction according to claim 6, wherein the electrical heating means comprises heating rods.

10. A diffusor guide vane construction according to claim 2, wherein said control flap means is supported on a journal member which is formed of memory alloy components, and wherein one journal end is fixedly arranged in an engine casing while the other end is pivotally supported in the casing.

11. A diffusor guide vane construction according to claim 10, wherein a heating rod is arranged in an axial bore of the journal member and an extension thereof.

12. a diffusor guide vane construction according to claim 10, wherein the journal member forming the memory alloy component has a twisted shape.

13. A diffusor guide vane construction according to claim 10, wherein the respective journal member extends into a chamber which is energized with process air which is taken from the engine cycle and the temperature of which is adapted to suite the desired deformation transition point.

14. A diffusor guide vane construction according to claim 13, wherein the chamber is arranged coaxially to an engine centerline.

15. A diffusor guide vane construction according to claim 13, wherein a plurality of guide vanes are provided, and wherein a plurality of separate chambers are provided into which respective journal members extend, and wherein the respective separate chambers are arranged rotationally symmetrically with respect to the respective journal member centerlines.

16. A diffusor guide vane construction according to claim 1, wherein said control flap means is supported on a pivotal journal member which is controllably supported by two spring components made of memory alloy provided to each act from one side on a lever arm of the journal member, and wherein the spring components are configured such that when a certain deformation transition temperature is reached, the one spring component is expanded and the other spring component is contracted such that an operationally induced temperature variation causes the desired actuation of the control flap means.

17. A diffusor guide vane construction according to claim 16, wherein the spring components of memory alloy are installed in housings with one end of the respective spring component being supported at a housing abutment and the remaining spring component end being carried as freely movable arms through respective openings in the housing cover to act on the lever arm.

18. A diffusor guide vane construction according to claim 1, wherein an engine control unit controls the deformation transition temperature at which the control flap means moves between the bypass duct blocking and opening positions.

19. A diffusor guide vane construction according to claim 1, wherein the guide vane is part of a cast diffusoor, wherein the control flap means take the form of control or shut-off flaps integrally cast at one end unaffected by control deformation with adjacent structural casing components or guidewall sections of the diffusor.

20. A diffusor guide vane construction according to claim 1, wherein the guide vane is part of a fabricated diffusor assembly, and wherein the control flap means are fixedly connected to the adjacent structure by local embedding.

21. A diffusor guide vane construction according to claim 3, wherein the memory alloy components are made of at least one of NiTi, CuZnAl, and CuAlNi alloys.

22. A diffusor guide vane construction according to claim 6, wherein the memory alloy components are made of at least one of NiTi, CuZnAl, and CuAlNi alloys.

23. A diffusor guide vane construction according to claim 3, wherein the control flap means are integrally connected at one end with adjacent defussor guide vane structure.

24. A diffusor guide vane construction according to claim 1, wherein a support journal for the control flap means is integrally connected at adjacent diffusor guide vane structure.

* * * * *